US009930466B2

(12) United States Patent
Ozerov et al.

(10) Patent No.: US 9,930,466 B2
(45) Date of Patent: Mar. 27, 2018

(54) METHOD AND APPARATUS FOR PROCESSING AUDIO CONTENT

(71) Applicant: THOMSON LICENSING, Issy les Moulineaux (FR)

(72) Inventors: Alexey Ozerov, Cesson-Sévigné (FR); Marie Guegan, Cesson-Sévigné (FR); Quang Khanh Ngoc Duong, Cesson-Sévigné (FR)

(73) Assignee: THOMSON Licensing, Issy-les-Moulineaux (FR)

( * ) Notice: Subject to any disclaimer, the term of this patent is extended or adjusted under 35 U.S.C. 154(b) by 0 days.

(21) Appl. No.: 15/366,470

(22) Filed: Dec. 1, 2016

(65) Prior Publication Data

US 2017/0180903 A1 Jun. 22, 2017

(30) Foreign Application Priority Data

Dec. 21, 2015 (EP) ..... 15307069

(51) Int. Cl.
*H04S 3/02* (2006.01)
*G10L 25/21* (2013.01)
*G10L 19/008* (2013.01)

(52) U.S. Cl.
CPC ..... *H04S 3/02* (2013.01); *G10L 19/008* (2013.01); *G10L 25/21* (2013.01); *H04S 2400/03* (2013.01); *H04S 2420/07* (2013.01)

(58) Field of Classification Search
CPC ..... G10L 19/008; G10L 25/21; H04S 3/02
See application file for complete search history.

(56) References Cited

U.S. PATENT DOCUMENTS 8,583,429 B2 11/2013 Benesty et al.
2006/0265210 A1 11/2006 Ramakrishnan et al.
2015/0380002 A1* 12/2015 Uhle ..... G10L 25/18 381/22

FOREIGN PATENT DOCUMENTS

WO WO2012077462 6/2012
WO WO2014195132 12/2014

OTHER PUBLICATIONS

Guan Naiyang et al: "Transductive nonnegative matrix factorization for semi-supervised high-performance speech separation",2014 IEEE International Conference Onacoustics, Speech and Signal Processing (ICASSP), IEEE,May 4, 2014 (May 4, 2014), pp. 2534-2538,XP032617370,DOI: 10.1109/ICASSP.2014.6854057 [retrieved on Jul. 11, 2014] section 2;section 2.1;section 3.

(Continued)

*Primary Examiner* — Mohammad Islam
(74) *Attorney, Agent, or Firm* — Brian J. Dorini; Joseph J. Opalach

(57) ABSTRACT

A method and apparatus for processing audio content is described. The method and apparatus include receiving (510) audio content, the audio content including an input audio signal, a first reference audio signal, and a second reference audio signal, determining (550) a processing function for the input audio signal, the processing function determined based on a cost function between the input audio signal, the first reference audio signal and a second reference audio signal, and processing (560) the input audio signal using the determined processing function in order to produce an output audio signal.

22 Claims, 4 Drawing Sheets

(56) References Cited

OTHER PUBLICATIONS

Barchiesi Daniele et al: "Reverse Engineering of a Mix",JAES, AES, 60 East 42nd Street, Room 2520New York 10165-2520; USA,vol. 58, No. 7/8, Jul. 1, 2010 (Jul. 1, 2010), pp. 563-576, XP040567060, the whole document.

Mandel Michael I et al: "Audio super-resolution using concatenative resynthesis",2015 IEEE Workshop on Applications Ofsignal Processing to Audio and Acoustics(WASPAA), IEEE,Oct. 18, 2015 (Oct. 18, 2015), pp. 1-5,XP032817898;DOI: 10.1109/WASPAA.2015.7336890[retrieved on Nov. 24, 2015] section 3;section 3.1;section 3.2.

Bryan, et al., "Interactive refinement of supervised and semi-supervised sound source separation estimates," in Proc. IEEE Int. Conf. on Acoustics, Speech, and Signal Processing (ICASSP), 2013, pp. 883-887.

Duong, et al., "An interactive audio source separation framework based on non-negative matrix factorization," IEEE International Conference on Acoustics, Speech, and Signal Processing (ICASSP'14), Florence, Italy, May 2014.

Sun, et al., "Non-negative matrix completion for bandwidth extension: a convex optimization approach," IEEE Machine Learning for Signal Processing, Sep. 2013.

Yu, et al., "Audio Denoising by Time-Frequency Block Thresholding", IEEE Transactions on Signal Processing, 56 (5): 1830-1839, May 2008.

Duong, et al., "Temporal Annotation-Based Audio Source Separation Using Weighted Nonnegative Matrix Factorization," Proc. IEEE International Conference on Consumer Electronics (ICCE-Berlin), Germany, Sep. 2014.

Vincent, et al., "Probabilistic modeling paradigms for audio source separation," in Machine Audition: Principles, Algorithms and Systems, IGI Global, 2010, ch. 7, pp. 162-185.

http://www.imaginecommunications.com/products/networking/processing/dts-neural-surround-upmix.

Dolby Pro Logic http://en.Wikipedia.org/wiki/Dolby_Pro_Logic.

Ramirez, Miguel Arjona, "Nonnegative Factorization of Sequences of Speech and Music Spectra", 2014 International Telecommunications Symposium (ITS).

Kirbiz, et al., "Perceptual Single-Channel Audio Source Separation by Non-Negative Matrix Factorization", 2009 IEEE 17th Signal Processing and Communications Applications Conference (SIU).

* cited by examiner

METHOD AND APPARATUS FOR PROCESSING AUDIO CONTENT

This application claims the benefit, under 35 U.S.C. § 119 of European Patent Application 15307069.3, filed Dec. 21, 2015.

TECHNICAL FIELD

The present disclosure generally relates to a method and apparatus for processing audio content. More specifically, the present disclosure relates to a mechanism that performs audio processing using reference audio signals in order to reproduce a set of audio signal characteristics in a target or desired audio signal.

DESCRIPTION OF BACKGROUND

This section is intended to introduce the reader to various aspects of art, which may be related to the present embodiments that are described below. This discussion is believed to be helpful in providing the reader with background information to facilitate a better understanding of the various aspects of the present disclosure. Accordingly, it should be understood that these statements are to be read in this light.

Audio processing remains an important part of media content generation and conversion in both home and professional settings. Several types of audio processing that are often used in particular with professional media content generation and conversion include, but are not limited to, audio restoration, audio remastering, audio upmixing (e.g., stereo audio to 5.1 audio conversion), audio downmixing (e.g., 5.1 audio to stereo audio conversion), audio source separation (e.g., extracting individual sound sources such as lead vocals), and reconstruction of a missing audio channel (e.g., sound scene capture by a particular microphone). All of these processing mechanisms are important to a wide range of professional studio applications as well as home audio applications. Furthermore, having fully automatic and efficient methods for the processing mechanism is highly desirable.

Some automatic processing solutions exist for the various types of audio processing used in media content generation and conversion. For example, audio restoration may consist of audio denoising and/or bandwidth extension. In some systems, denoising may also be accompanied by some frequency equalization. Further, solutions exist for separating audio sources automatically. For audio upmixing, some fully automatic solutions have been proposed by Dolby (e.g., Pro Logic II) and Digital Theater Sound (DTS) (e.g., Neural Surround™ UpMix). However, these solutions are only satisfactory to a certain extent. Automatic source separation, while possible, often leads to results that are far from being satisfactory, and user-guided methods may lead to much better results. As for audio restoration, remastering, upmixing and downmixing, even the final result of such such audio processing is not always uniquely specified and may be a product of many subjective decisions. For example, during audio upmixing one sound engineer may decide to put drums in the center while mixing a song and another sound engineer may decide to put them slightly to the left. As for above-mentioned existing automatic stereo audio to 5.1 audio upmixing solutions by Dolby and DTS, these solutions often consist of a simple spreading of the stereo content over the six audio channels in 5.1 audio without analyzing each particular sound, such as, e.g., lead vocals, drums, etc.

The existing solutions for the above-described problems are still far from a good compromise between a solution that is fully automatic (i.e., does not need any human intervention), and a solution that may only be semi-automatic or more user interactive while producing high quality results. Therefore, there is a need for an improved mechanism for automatic processing of audio content during media content generation or conversion, such as audio restoration, audio remastering, audio upmixing, audio downmixing, audio source separation, or reconstruction of a missing audio channel.

SUMMARY

According to an aspect of the present disclosure, a method is described. The method includes receiving audio content, the audio content including an input audio signal, a first reference audio signal, and a second reference audio signal, determining a processing function for the input audio signal, the processing function determined based on a cost function between the input audio signal, the first reference audio signal and a second reference audio signal, and processing the input audio signal using the determined processing function in order to produce an output audio signal.

According to another aspect of the present disclosure, an apparatus is described. The apparatus includes an input interface that receives audio content, the audio content including an input audio signal, a first reference audio signal, and a second reference audio signal, and a processor coupled to the input interface, the processor determining a processing function for the input audio signal, the processing function determined based on a cost function between the input audio signal, the first reference audio signal and the second reference audio signal, the processor further processing the input audio signal using the determined processing function in order to produce an output audio signal.

The above presents a simplified summary of the subject matter in order to provide a basic understanding of some aspects of subject matter embodiments. This summary is not an extensive overview of the subject matter. It is not intended to identify key/critical elements of the embodiments or to delineate the scope of the subject matter. Its sole purpose is to present some concepts of the subject matter in a simplified form as a prelude to the more detailed description that is presented later.

BRIEF SUMMARY OF THE DRAWINGS

These and other aspects, features, and advantages of the present disclosure will be described or become apparent from the following detailed description of the preferred embodiments, which is to be read in connection with the accompanying drawings.

Figure 1:
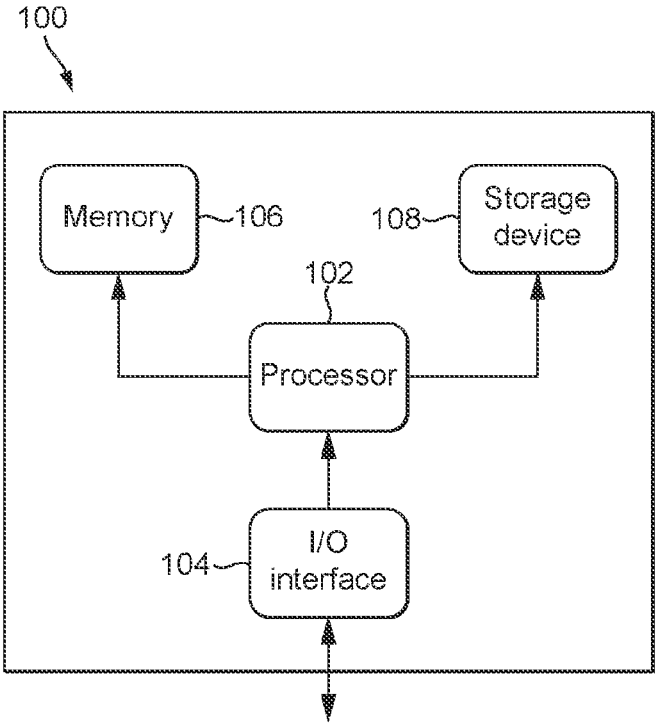
FIG. 1 is a block diagram of an exemplary embodiment of a device for processing audio content in accordance with the present disclosure.

It should be understood that the drawing(s) are for purposes of illustrating the concepts of the disclosure and are not necessarily the only possible configuration for illustrating the disclosure.

DETAILED DESCRIPTION

It should be understood that the elements shown in the figures may be implemented in various forms of hardware, software or combinations thereof. Preferably, these elements are implemented in a combination of hardware and software on one or more appropriately programmed general-purpose devices, which may include a processor, memory and input/output interfaces. In the following, the phrase "coupled" is defined to mean directly connected to or indirectly connected with through one or more intermediate components. Such intermediate components may include both hardware and software based components.

The present description illustrates the principles of the present disclosure. It will thus be appreciated that those skilled in the art will be able to devise various arrangements that, although not explicitly described or shown herein, embody the principles of the disclosure and are included within its scope.

All examples and conditional language recited herein are intended for educational purposes to aid the reader in understanding the principles of the disclosure and the concepts contributed by the inventor to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Thus, for example, it will be appreciated by those skilled in the art that the block diagrams presented herein represent conceptual views of illustrative circuitry embodying the principles of the disclosure. Similarly, it will be appreciated that any flow charts, flow diagrams, state transition diagrams, pseudocode, and the like represent various processes which may be substantially represented in computer readable media and so executed by a computer or processor, whether or not such computer or processor is explicitly shown.

The functions of the various elements shown in the figures may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, read only memory (ROM) for storing software, random access memory (RAM), and nonvolatile storage.

Other hardware, conventional and/or custom, may also be included. Similarly, any switches shown in the figures are conceptual only. Their function may be carried out through the operation of program logic, through dedicated logic, through the interaction of program control and dedicated logic, or even manually, the particular technique being selectable by the implementer as more specifically understood from the context.

In the claims hereof, any element expressed as a means for performing a specified function is intended to encompass any way of performing that function including, for example, a) a combination of circuit elements that performs that function or b) software in any form, including, therefore, firmware, microcode or the like, combined with appropriate circuitry for executing that software to perform the function. The disclosure as defined by such claims resides in the fact that the functionalities provided by the various recited means are combined and brought together in the manner which the claims call for. It is thus regarded that any means that can provide those functionalities are equivalent to those shown herein.

The present disclosure addresses issues related to improving audio process in order to produce an audio signal having a particular set of aural characteristics based on a reference signal. These audio processing problems are most often found in audio restoration, audio remastering, audio upmixing (e.g., stereo to 5.1 audio conversion), audio downmixing (e.g., 5.1 audio to stereo conversion), audio source separation (e.g., extracting individual sound sources such as, "lead voice"), and audio reconstruction of a missing audio channel (e.g., sound scene capture by a particular microphone). The audio processing functions described here often involve attempting to mimic or recreate, as close as possible, the processing applied to, and results achieved by, a reference or example audio content, such as audio content previously processed. In performing one of the above audio processing functions, fully automatic processing techniques have not proven to be easy or effective. The present disclosure uses reference signals, such as a reference or example input audio signal and a reference or example audio output signal that was produced by previous processing of the reference or example input audio signal as part of processing a desired input signal to generate a desired or target output signal.

By using a plurality of signals, the present embodiments provide a unified solution to the above-described problems as long as an example of the corresponding processing is given in terms of an input and an output audio recording. For example, aspects of the embodiments described herein may be used for upmixing a stereo recording as an input signal to produce a desired 5.1 audio signal. In one instance, a part of the input recording that has already been upmixed to produce an output signal is used as reference signals. In another instance, a different stereo recording that has been similarly upmixed from stereo to 5.1 audio can be used as input and output reference signals.

The present disclosure describes an apparatus and method producing an audio output signal from a received input signal that has aural characteristics (stereo, multichannel, frequency response, spatial position of instruments) that are similar to a reference or example signal. The desired received signal is processed along with a reference input and reference output signal related to each other by a processing function that is either unknown or not completely identified to produce a desired output signal from the desired received signal based on a cost function, and more particularly based on minimizing a cost function, between the signals provided. The processing produces an audio output signal from the desired received signal that corresponds to processing of the reference input signal to produce the reference audio output signal. The resulting desired output signal may, as a result, include one or more of the characteristics associated with the processing of the reference or example input signal to produce the reference output signal.

The present embodiments may be particularly useful when complex audio signal processing may be needed or required (e.g., nonreversible processing). For example, during upmixing, the spatial placement of sound elements from stereo audio to 5.1 channel audio may result in producing multiple inverse relationships when considering a conversion back to stereo or downmixing. A simple analysis of reference audio content may not result in determining the correct or desired spatial placement. The embodiments may also be useful when it is desirable to match one or more signal characteristics for two signals having the same audio content but provided by, or generated from, two different sources (e.g., the same audio signal recorded in two different environmental conditions). The present embodiments may also be useful for transferring one or more aural characteristics between audio signals that contain different audio content.

One or more embodiments describe computing spectrograms and power spectrograms (i.e., nonnegative matrices) for a set of signals (e.g., desired input signal, reference or example input signal as a first reference audio signal, and reference or example output signal as a second reference audio signal) based on a short time Fourier transform (SIFT) function. A spectrogram is a time/frequency representation of the signal by windowing the time domain and computing separate Fourier transforms over each window to produce a time varying frequency domain signal. A power spectrogram may be produced by squaring the coefficients in the spectrogram to display magnitude information and remove phase information. The power spectrograms are concatenated into a single nonnegative matrix (i.e., a matrix in which all elements are greater than zero) with missing values that correspond to the power spectrum of the target recording. As such, the problem of predicting the missing power spectrogram or portion of the concatenated matrix is formulated as a nonnegative matrix completion problem. The nonnegative matrix completion problem is solved via a nonnegative matrix factorization (NMF) method and based on a cost function. After reconstructing the missing power spectrogram associated with a desired output signal in the matrix through minimizing the cost function, the desired audio signal is obtained by performing an inverse STFT along with a filtering process involving the initial desired audio signal in order to estimate the phase characteristics of the desired output signal.

Turning to FIG. 1, a block diagram of an exemplary device 100 according to principles of the present disclosure is shown. Device 100 may be a mobile device, such as a cellular phone or tablet, having audio signal processing capability. Device 100 may also be used as part of a professional sound processing system often found in a production studio. Device 100 includes a processor 102. Processor 102 is coupled to an input/output (I/O) interface 104 as well as memory 104 and storage device 106. It is important to note that in an effort to be concise, some elements necessary for operation of device 100 are not shown or described here as they are well known to those skilled in the art.

Audio signals used for audio processing are provided to the I/O interface 104. The I/O interface may be wired (e.g., Ethernet) or wireless (e.g., Institute of Electrical and Electronics Engineers (IEEE) standard 802.11). The I/O interface may also include any other communication protocols needed to allow operation on a global network (e.g., the Internet) as well as to communicate with other computers or servers (e.g., cloud based computing or storage servers). Software code for processing the audio signals may also be provided through I/O interface 104 as part of an Internet based service or storage system, such as the Software as a Service (SAAS) feature remotely provided to device 100.

The audio signals received at I/O interface 104 are provided to processor 102. Additionally, in some embodiments, software code that is provided as part of an Internet based system may also be provided to processor 102. Processor 102 may perform a variety of audio processing functions. In one embodiment, processor 102 may include functions to support audio restoration, audio remastering, audio upmixing, audio downmixing, audio source separation, and audio reconstruction of a missing audio channel as well as other audio processing functions. One or more aspects of the audio processing functions present in processor 102 will be further described below. The final processed audio signal output from processor 102 is provided to I/O interface 104.

Memory 106 may be used to store operating code used by processor 102. Memory 106 may be used to store one or more audio signals as well as intermediate data during processing of the audio signals. Storage device 108 may also be used to store the received audio signals for a longer time period and may also store the final processed audio signal output. In some embodiments, delayed audio processing in processor 102 may be accomplished by first providing the received audio signals from I/O interface 104 to either memory 106 or storage device 108. Processor 102 retrieves the audio signals and processes the signals prior to providing the processed output signal back to I/O interface 102 or back to either memory 106 or storage device 108 for later retrieval.

It is important to note that a device having the same or similar features to device 100 may be included in a home electronics system such as a home computer, a media receiver, a settop box, a home media recording device or the like. The same or similar device to device 100 may also be included in a personal electronics device including, but not limited to, a cellular phone, a tablet, and a personal media player.

In operation, device 100 processes a set of audio signals consisting of a desired audio input signal along with a reference or example audio input signal and a reference or example audio output signal in order to generate a desired target audio output signal. The desired audio input signal, reference audio input signal, and the reference audio output signal may be received through I/O interface 104 and provided to processor 102. Alternatively, one or more of the desired audio input signal, reference audio input signal, and the reference audio output signal may be provided to processor 102 from either memory 106 or storage device 108, having been previously provided to device 100 (e.g., through I/O interface 104 or otherwise downloaded into memory 106 or storage device 108).

Figure 2:
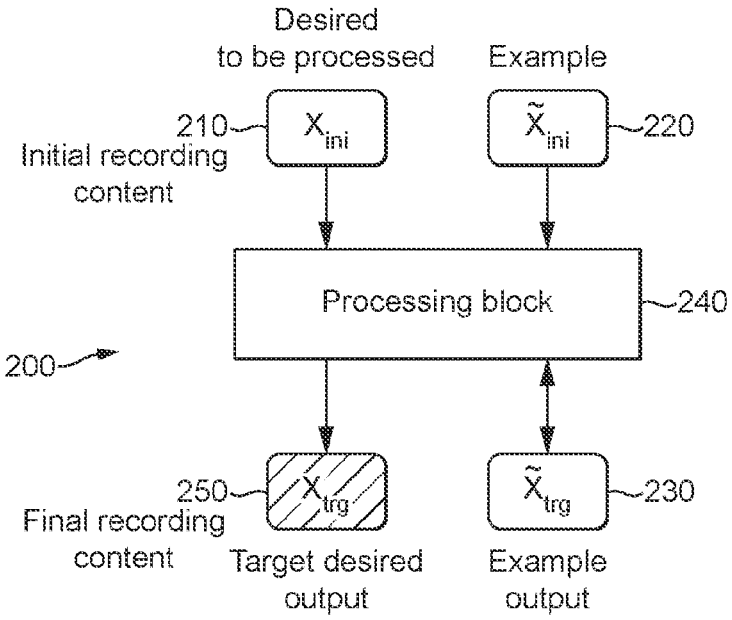
FIG. 2 is a diagram of illustrating the processing of audio content in accordance with the present disclosure.

Turning to FIG. 2, a diagram 200 of the relationship between the audio signals and the audio processing arrangement based on principles of the present disclosure described herein is shown. A processing block 240, operating in a manner similar to processor 102 described in FIG. 1, is coupled with the following signals:

- $x_{ini}$: initial recording (input) to be processed, labelled 210
- $\tilde{x}_{ini}$: example initial recording (input) that is already processed, labelled 220
- $x_{trg}$: target recording (output) that is the result of $x_{ini}$ processing, labelled 250

$\tilde{x}_{trg}$: example target recording (output) that is the result of $\tilde{x}_{ini}$ processing, labelled 230

In a normal audio processing arrangement, the initial recording content (e.g., $x_{ini}$ 210 and $\tilde{x}_{ini}$ 220) is provided to processing block 240. Processing block produces the final recording content (e.g., $x_{trg}$ 250 and $\tilde{x}_{trg}$ 230) based on the audio processing functions used in processing block 240. However, as mentioned above, this processing technique may not assure that $x_{trg}$ 250 is processed to have characteristics that are the same or similar to $\tilde{x}_{trg}$ 230.

According to aspects of the present disclosure, processing block 240 receives and processes three input signals, $x_{ini}$ 210, $\tilde{x}_{ini}$ 220, and $\tilde{x}_{trg}$ 230. Processing block 240 processes all of the received signals to produce $x_{trg}$ 250. In one embodiment, processing block 240 converts all the received signals into spectrograms using STFT processing. The spectrograms are used to form matrix relationships that are used to determine the spectrogram for an output signal $x_{trg}$ 250 based on one or more cost functions. The output signal $x_{trg}$ 250 is generated by applying an inverse STFT to the spectrogram. The present embodiments produce an improved fully automatic processing mechanism by using both an example input audio signal and an example output signal to determine the processing operations and relationships for a desired input signal to produce a desired target output audio signal.

Figure 3:
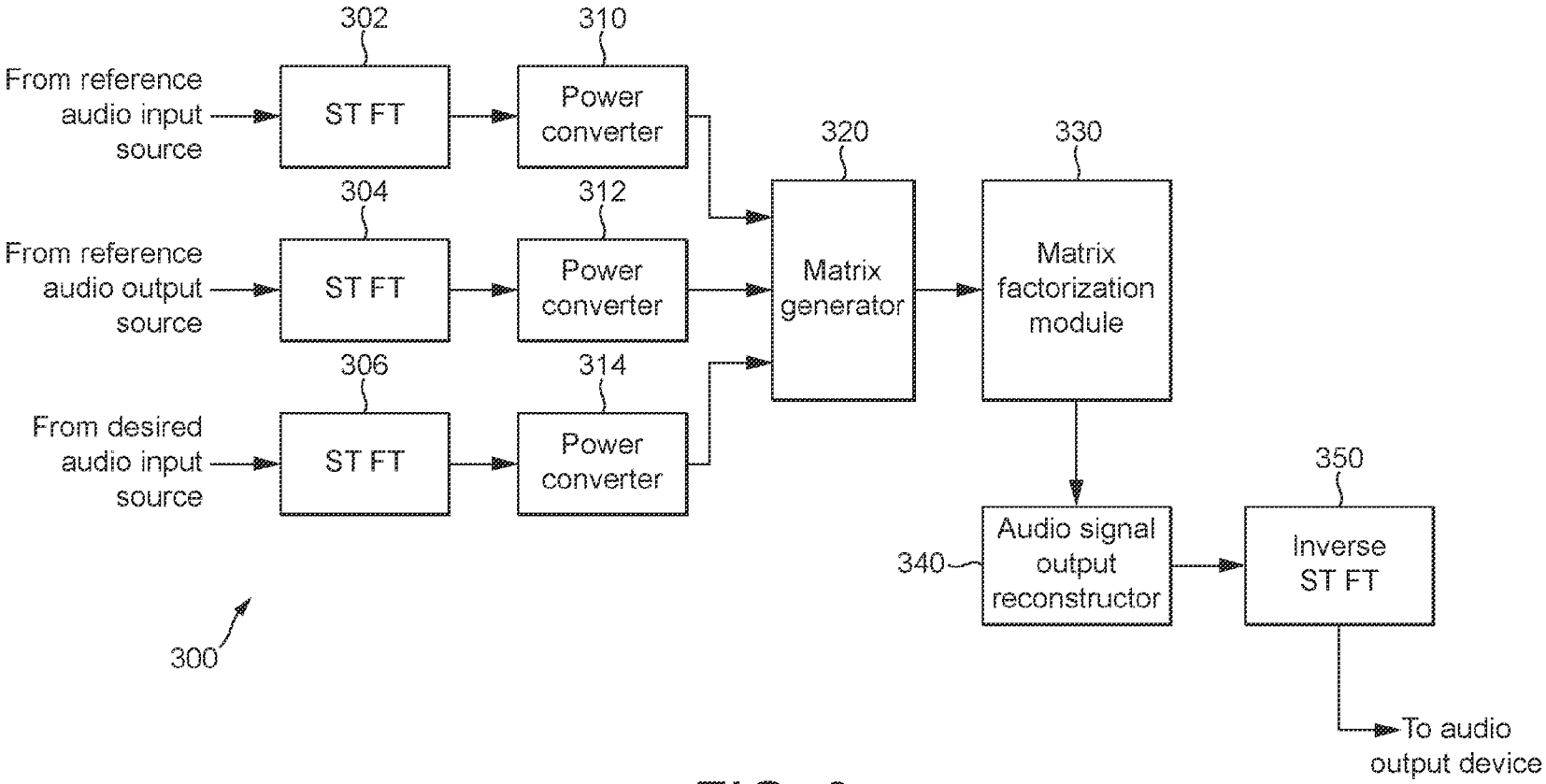
FIG. 3 is a block diagram of another embodiment of a device for processing audio content in accordance with the present disclosure.

Turning to FIG. 3, a block diagram of another exemplary device 300 according to principles of the present disclosure is shown. Device 300 operates in a manner similar to device 100 described in FIG. 1. Further, device 300 may be included in a larger signal processing circuit and used as part of a larger device including, but not limited to, a professional audio mixer, a professional sound reproduction device, a home media server, and a home computer. For example, one or more elements described in device 300 may be incorporated in processor 102 described in FIG. 1. It is important to note that in an effort to be concise, some elements necessary for operation of device 300 are not shown or described here as they are well known to those skilled in the art Content from a reference audio input source is provided to SIFT 302. Content from a reference audio output source that was produced through processing the reference audio input signal is provided to SIFT 304. Content from a desired or target audio input source is provided to SIFT 306. SIFT 302 is coupled to power converter 310. STFT 304 is coupled to power converter 312. STFT 306 is coupled to power converter 314. Power converter 310, power converter 312, and power converter 314 are coupled to matrix generator 320. Matrix generator 320 is coupled to matrix factorization module 330. Matrix factorization module 330 is provided to audio signal output reconstructor 340. Audio signal output reconstructor 340 is coupled to inverse STFT 350. The output of inverse STFT 350 is provided to an audio output device such as an amplifier and speakers for audio reproduction, or another audio processing device for further audio processing.

Audio content associated with the reference audio input source is provided to STFT 302. Additionally, audio content associated with the reference audio output source is provided to STFT 304. Similarly, audio content associated with the desired audio input source is provided to STFT 306. The audio content for STFT 302, 304, and/or 306 may be received from an external device through an input or input/output interface on device 300, similar to I/O interface 104 described in FIG. 1. The audio content for STFT 302, 304, and/or 306 may alternatively be received from a storage device included in device 300 (not shown), similar to memory 106 or storage device 108 described in FIG. 1. Each of the received signals are processed using an STFT process and further provided to power converter 310, power converter 312, and power converter 314 respectively. Power converters 310, 312, 314 convert the STFT signals into power spectrograms. Each of the power spectrograms from power converters 310, 312, 314 are provided to matrix generator 320. Matrix generator 320 forms a first matrix using the power spectrograms and includes a set of fixed values at locations in the matrix for the power spectrogram representing the desired target audio output signal. Matrix generator 320 also forms a second matrix similar to the first matrix that includes the power spectrograms. The second matrix is used as a weighting matrix during additional processing in matrix factorization module 330.

The matrices from matrix generator 320 are provided to matrix factorization module 330. Matrix factorization module 330 adjusts the matrix relationship in order to allow matrix processing to determine the missing or unknown matrix elements association with the power spectrogram representing the desired or target audio output signal using a cost function.

The reconfigured or factored matrices including spectrogram estimates for the desired target audio output signal determined in matrix factorization module 330 are provided to audio signal output reconstructor 340. Audio signal output reconstructor 340 further processes the matrices to extract the complex-valued STFT coefficients for the desired target audio output signal. Audio signal output reconstructor 340 may also filter the signal to improve the resulting coefficients. Further details regarding the determination of the spectrogram and generation of the desired target output signal will be described below.

The complex-valued STFT coefficients determined from the audio signal output reconstructor 340 are provided to inverse STFT 350. The inverse STFT 350 converts the complex-valued STFT coefficients for the time varying frequency domain signal to a time domain signal using an inverse STFT function. The resulting time domain signal, representing the desired or target audio output signal, is provided as a device output for use by other audio processing. The audio processing may be included in additional professional audio processing, reproduction equipment and amplified aural reproduction equipment, and the like.

It is important to note that device 300 may be embodied as separate standalone devices or as a single standalone device. Each of the elements in device 300, although described as modules, may be individual circuit elements within a larger circuit, such as an integrated circuit, or may further be modules that share common processing circuit in the larger circuit. Device 300 may also be incorporated into a larger device, such as a microprocessor, microcontroller, or digital signal processor. Further, one or more the blocks described in device 300 may be implemented in software or firmware that may be downloaded and include the ability to be upgraded or reconfigured.

In one embodiment, device 300 may process a set of mono or single channel audio signals to produce a desired mono or single channel audio output signal to produce an output signal having a desired set of aural characteristics (e.g., audio restoration). It is assumed that the following single channel audio recordings are available and provided to SIFT 302, SIFT 304, and SIFT 306:

$x_{ini}$: initial recording (input) to be processed, $\tilde{x}_{ini}$: example initial recording that is already processed, $\tilde{x}_{trg}$: example target recording that is the result of $\tilde{x}_{ini}$ processing.

The STFT coefficients, as complex-valued matrices $X_{ini}$, $\tilde{X}_{ini}$, and $\tilde{X}_{trg}$ representing the time varying frequency domain values for each of the three input signals $x_{ini}$, $\tilde{x}_{ini}$ and $\tilde{x}_{trg}$, are computed and determined in STFTs 302, 304, and 306 respectively. The power spectrograms, as real-valued nonnegative matrices $V_{ini}$, $\tilde{V}_{ini}$, and $\tilde{V}_{trg}$, are determined as absolute values or squared absolute values for $X_{ini}$, $\tilde{X}_{ini}$ and $\tilde{X}_{trg}$ in power converters 310, 312, and 314 respectively. Specifically, $V_{ini}(f,n)=|X_{ini}(f,n)|^2$, where f and n denote STFT frequency and time indices, respectively.

A matrix V is created or formed in matrix generator 320 by concatenating matrices $V_{ini}$, $\tilde{V}_{ini}$ and $\tilde{V}_{trg}$, while replacing the missing part corresponding to $V_{trg}$ by any values (e.g., zeros). A weighting matrix B of the same size as V, as a second matrix, is also formed in matrix generator 320. As mentioned above, the weighting matrix B is needed to properly handle missing values in V during estimation, and all its entries may be non-zero (e.g., equal to one) except the part corresponding to missing matrix $V_{trg}$, where the entries are all zero. For the non-zero part of this matrix, other weighting strategies may also be considered, such as putting higher weights (i.e. higher values in matrix B) in the parts corresponding to either one or both of the example or reference signals if these example or reference signals are very good and the processing should rely more on these example or reference signals.

The observed part of matrix V having a size F×N is approximated in matrix factorization module 330 by a product of two nonnegative matrices W and H of size F×K and K×N, respectively (K is usually smaller than both F and N):

$$V(f,n)\approx\hat{V}(f,n)=[WH](f,n) \text{ if and only if } B(f,n)=1 \qquad \text{(equation 1)}$$

Figure 4:
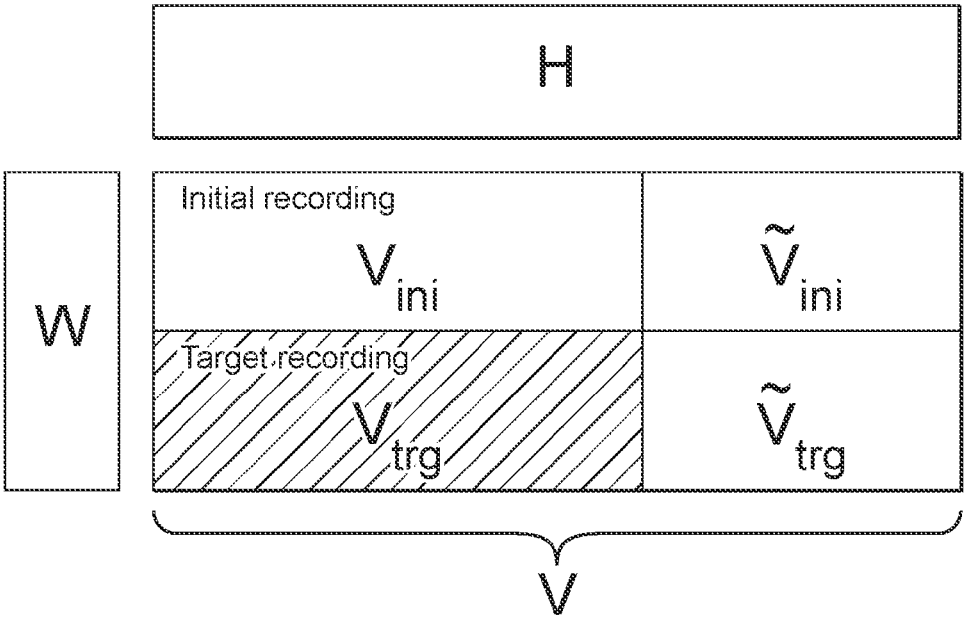
FIG. 4 is a diagram illustrating a relationship of the audio processing performed in a device in accordance with the present disclosure.

FIG. 4 illustrates an example matrix relationship associated with matrix factorization module 330. The result of the equation above is achieved by minimizing the following cost function:

$$c(W,H)=\Sigma_{f,n=1}^{F,N}B(f,n)d_{IS}(V(f,n)|[WH](f,n)), \qquad \text{(equation 2)}$$

where $d_{IS}(x|y)=x/y-\log(x/y)-1$ is a divergence.

In one embodiment the above cost function may correspond to a weighted Itakura-Saito (IS) divergence. Other cost functions utilizing a different divergence may also be used, such as Euclidian distance or Kullback Leibler divergence. An effective parameter optimization, minimizing the above-described cost function, is achieved by iterating the following multiplicative update rules:

$$H \leftarrow H \odot \frac{W^T((B\odot WH)^{\cdot -2}\odot V)}{W^T(B\odot WH)^{\cdot -1}}, \qquad \text{(equation 3)}$$

$$W \leftarrow W \odot \frac{((B\odot WH)^{\cdot -2}\odot V)H^T}{(B\odot WH)^{\cdot -1}H^T}, \qquad \text{(equation 4)}$$

where $\odot$ denotes element-wise matrix multiplication, $V^{\cdot -p}$ denotes element-wise matrix power, and all divisions are element-wise as well.

Once matrices W and H have been estimated, entries of matrix $\hat{V}$ can be calculated for all indices based on the following relationship in audio signal output reconstructor 340:

$$\hat{V}(f,n)=[WH](f,n) \qquad \text{(equation 5)}$$

The $\hat{V}_{ini}$ and $\hat{V}_{trg}$ submatrices of matrix $\hat{V}$, calculated in audio signal output reconstructor 340, correspond respectively to the power spectrogram for the desired input signal (e.g., submatrix $V_{ini}$) and the desired target output signal (e.g. submatrix $V_{trg}$) of matrix V. The complex-valued STFTs for the desired target output signal are estimated from the resultant power spectrogram (e.g., submatrix $\hat{V}_{trg}$) using the following filtering:

$$X_{trg} = X_{ini} \odot \left(\frac{\hat{V}_{trg}}{\hat{V}_{ini}}\right)^{\alpha}, \qquad \text{(equation 6)}$$

where matrix division is applied element-wise and $\alpha>0$ and a constant (e.g., $\alpha=0.5$ or $\alpha=1$).

It is important to note the filtering described above in equation 6 requires submatrices $\hat{V}_{ini}$ and $\hat{V}_{trg}$ to have the same size and/or dimensionality. However, these submatrices will not be the same size if the initial or input signal and target or output signal have different sample frequencies. For example, the initial or input signal and target or output signal may have different sample frequencies if a bandwidth expansion process or function is applied to the initial or input signal. The particular cases of different sample frequencies for the initial or input signal and the target or output signal may be processed as follows.

If the initial signals are sampled with a higher sample frequency than the target signals (i.e., submatrix $\hat{V}_{ini}$ is taller than submatrix $\hat{V}_{trg}$), submatrix $\hat{V}_{ini}$ in equation 6 is reduced to have the same size as $V_{trg}$ by dropping, removing, or deleting the corresponding high frequencies that are missing in $\hat{V}_{trg}$. Accordingly, $\hat{X}_{ini}$ in equation 6 is similarly restricted as well.

If the initial signals are sampled with a lower sample frequency than the target signals (i.e., submatrix $\hat{V}_{ini}$ is smaller than submatrix $\hat{V}_{trg}$), the corresponding lower frequency portions of all matrices (i.e., the parts corresponding to the largest frequency range presented in both signals) are processed as described in equation 6. The remaining higher frequencies cannot be reconstructed using equation 6, since $\hat{V}_{ini}$ and $X_{ini}$ are unknown for these frequencies. Instead, the amplitude of $X_{trg}$ in this higher frequency range is estimated as $(\hat{V}_{trg})^{\alpha}$ ($\alpha>0$ and is usually chosen as $\alpha=0.5$). The phase of $X_{trg}$ in this frequency range can be reconstructed based on signal estimation algorithm applied to a modified STFT, such as the Griffin and Lim algorithm.

The time domain desired target output signal $x_{trg}$ is obtained from $X_{trg}$ by applying an inverse STFT process in inverse STFT 350.

Multichannel (e.g., stereo or 5.1 audio) audio content may be processed in a manner similar to the embodiment described above. The matrices $V_{ini}$, $\hat{V}_{ini}$ and $\hat{V}_{trg}$ are obtained by vertical concatenation of the corresponding spectrograms as separate channels. The missing audio signal reconstruction in audio signal output reconstructor 340 further includes a filtering process that is applied channel-wise. In one embodiment, the filtering is applied to each pair of input-output channels and then averaged over the input channels.

It is important to note that, although the above embodiments specifically describe processing relationships between input and output signals, processing relationships may similarly be transferred for signals having the same content but acquired from different sources. As an example use of the present embodiments, two different recordings having the same source content are used to replace a missing segment of content in one of the recordings. Content acquired from a content source in the audience of a live musical performance (e.g., from a microphone included with a video camera) is identified as a first reference audio source, $\hat{V}_{ini}$. The same content acquired from the sound control system for the same live musical performance (e.g., recorded directed from the output of a sound mixing console) is identified as a second reference audio source, $\hat{V}_{trg}$. The first reference audio signal includes crowd noise not present in the second reference audio signal. Further, the second reference audio signal has voice level in the audio content that is much higher than the voice level present in the first reference audio signal. The content for the entire live musical performance may be used or only a portion of the content (other than the portion described below) for the live musical performance may be used for the first and second reference audio signals.

The content acquired from the sound control system is missing a content segment. The portion of the content acquired from the content source in the audience that is equivalent to the missing content segment for the content from the sound control system is identified as the desired input audio, $\hat{V}_{ini}$.

The desired target output audio signal, $\hat{V}_{trg}$, becomes the missing content segment for the content from the sound control system using the desired input audio signal. The desired target output audio is produced from the desired input signal in that the desired input audio signal is processed using a processing function that corresponds to a processing relationship between the first reference audio signal and the second reference audio signal. In particular, the crowd noise is significantly reduced and voice level relative to the rest of the musical content is higher in the desired target output audio signal that what was present in the desired input audio, mimicking more closely the relationship between the first reference audio signal and the second reference audio signal. While the processing mechanism described above may not perfectly replicate the original missing content segment, the processing mechanism may produce a close approximation that may be used to provide improved audio content to a user.

Figure 5:
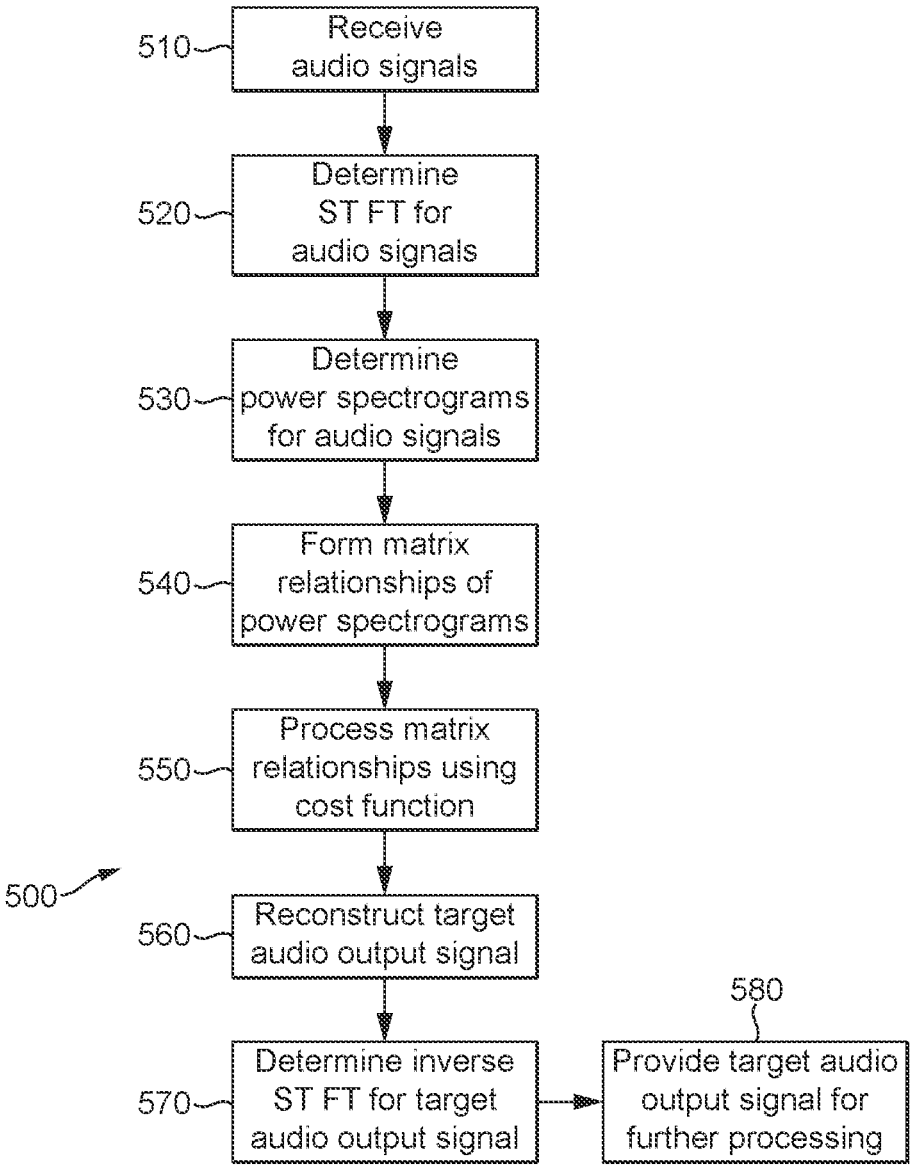
FIG. 5 is a flowchart of a process for processing audio content in accordance with the present disclosure.

Turning to FIG. 5, a flow chart illustrating a process 500 for processing audio content according to aspects of the present disclosure is shown. Process 500 will primarily be described in terms of device 300 described in FIG. 3. Process 500 may also be used as part of the operation of device 100. Some or all of the steps of process 500 may be suitable for use in devices, such as audio reproduction devices, audio playback devices (including but not limited to mobile phones, tablets, game consoles, and head mounted displays) and the like. It is important to note that some steps in process 500 may be removed or reordered in order to accommodate specific embodiments associated with the principles of the present disclosure.

Process 500 begins, at step 510, by receiving audio signals. The audio signals include a desired audio input signal to be processed. The audio signals also include a reference or example input signal along with a corresponding output signal following processing. The processing produces an audio output signal from the desired input audio signal that corresponds to, or mimics, processing of the reference audio input signal to produce the reference audio output signal. In other words, the processing that was applied originally to the reference or example input signal to produce the reference or example output signal is learned and applied as processing to the desired input signal. The processing may include modification of aural characteristics of the desired or target input signal such that one or more of the aural characteristics from the reference or example audio signal are transferred to the desired or target audio output signal.

Next, at step 520, the STFT coefficients are determined for the three audio signals received at step 510. At step 530, power spectrograms are determined for each of the three audio signals based on the STFT coefficients.

At step 540, a matrix relationship is formed by concatenating the spectrograms from each of the three received audio signals and including a portion of the matrix representing the undetermined spectrogram for the desired audio output signal. The portion of the matrix representing the undetermined spectrogram may be loaded with any values. Also, at step 540, an additional matrix is formed having the same size as the first matrix. The additional matrix is needed to properly handle the undetermined values in the first matrix during further computation and estimation. The additional matrix may have all entries equal to a value of one except for the portion corresponding to the undetermined values with entries equal to zero. For non-zero part of the additional matrix, other weighting strategies (e.g., values larger or smaller than one) may also be considered and used depending on, for instance, the similarity of the example or reference signal(s) to the desired signal(s).

Next, at step 550, the matrix relationships are processed using a cost function. The matrices are first partitioned into matrix product by a product of two nonnegative matrices W×H having sizes F×K and K×N, respectively, as illustrated in FIG. 4. The cost function is minimized and may be based on a divergence (e.g., a weighted IS divergence) or any other suitable cost function. The minimization as part of the cost function processing, at step 550, may be achieved using an iteration mechanism following multiplicative update rules or any similar iterative update mechanism. As a result, at step 550, the audio processing function to be used between the desired input signal and the desired output signal based on the reference input signal and the reference output signal is determined.

Next, at step 560, the undetermined values for the desired audio output signal in the first matrix are calculated for all indices resulting in an estimate for the undetermined power spectrogram (e.g., the power of the matrix associated with the desired output signal). Also, at step 560, the newly determined power spectrogram is filtered to produce a set of complex-valued STFT coefficients representing the time varying frequency domain desired output signal. At step 570, the time values for the target or desired audio output signal are determined by applying an inverse STFT to the complex-valued STFT coefficient values determined at step 560. Steps 560 and 570 constitute the processing that is performed on the desired input signal to produce the desired output signal from the desired input signal based on the processing function determined at step 550.

Finally, at step 580, the target or desired output signal is provided for further processing. The signal may be provided to amplifier and speakers for aural reproduction. The signal may also be provided to another audio processing device or media production device as part of a professional studio operation.

It is important to note that some or all of the elements of process 500 may be included in software or firmware that is loaded into a computing or processing device, such as device 100 described in FIG. 1. The software may reside on the device or may reside on an external computer readable medium, such as compact disk (CD), digital versatile disk (DVD) or magnetic or other electronic storage drive. In some embodiments, the external computer readable medium may be located remotely and connected to the processing device through some form of a network connection. The processing device may further download the software to a local storage element prior to executing the control code or may execute the control code in the software through the network connection. For example, the elements of process 500 may be included in a app that may be downloaded to a device, such as a mobile phone, tablet, or game console.

The embodiments described above allow performing various audio processing tasks in manner that minimizes or eliminates external (e.g., user) interaction given that an example of such a processing task is available and provided. The described embodiments may be used to reduce manual processing time by a user while maintaining audio processing quality. The embodiments may be used to automatically propagate or transfer processing or one or more characteristics of processing performed on a portion of the media content to the entire media content.

For instance, a sound engineer may upmix only a portion of a recording of audio content or an operator may separate only a portion of a recording of audio content using user-guided processing, since treating the full recording is too time consuming. The remaining audio content may be processed using one or more aspects of the present disclosure. The embodiments may also be used to mimic or replicate particular aspects of the processing or one or more aural characteristics present on a different source of the same content (e.g., producing an improved live recording of content by using a similar professional studio implementation of the same content) or may be used to transfer the aural characteristics from completely different content.

It is to be appreciated that one or more of the various features and elements shown and described above may be interchangeable. Unless otherwise indicated, a feature shown in one embodiment may be incorporated into another embodiment. Further, the features and elements described in the various embodiments may be combined or separated unless otherwise indicated as inseparable or not combinable.

It is to be further understood that, because some of the constituent system components and methods depicted in the accompanying drawings are preferably implemented in software, the actual connections between the system components or the process function blocks may differ depending upon the manner in which the present. Given the teachings herein, one of ordinary skill in the pertinent art will be able to contemplate these and similar implementations or configurations of the present embodiments.

In one embodiment, a method may include receiving audio content, the audio content including an input audio signal, a first reference audio signal, and a second reference audio signal, determining a processing function for the input audio signal, the processing function determined based on a cost function between the input audio signal, the first reference audio signal and a second reference audio signal, and processing the input audio signal using the determined processing function in order to produce an output audio signal.

In another embodiment, an apparatus includes an input interface that receives audio content, the audio content including an input audio signal, a first reference audio signal, and a second reference audio signal, and a processor coupled to the input interface, the processor determining a processing function for the input audio signal, the processing function determined based on a cost function between the input audio signal, the first reference audio signal and the second reference audio signal, the processor further processing the input audio signal using the determined processing function in order to produce an output audio signal.

In some embodiments, the cost function is formed using a first matrix containing a first submatrix associated with the input audio signal, a second submatrix associated with the first reference audio signal, a third submatrix associated the second reference audio signal, and a fourth submatrix associated with the output audio signal.

In some embodiments, the fourth submatrix initially includes values equal to a constant value.

In some embodiments, the cost function is further formed using a second matrix having a dimensionality equal to the first matrix and including a submatrix located in a portion of the second matrix that is equivalent to the fourth submatrix in the first matrix, the fourth submatrix having values equal to zero.

In some embodiments, a portion of the second matrix not including the submatrix portion has values that are nonzero and dependent on the weighting of the first reference audio signal and the second reference audio signal in the cost function.

In some embodiments, the determining further includes computing a short time fourier transform for the input audio signal, the first reference audio signal, and the second reference audio signal, and computing a power spectrogram for the input audio signal, the first reference audio signal, and the second reference audio signal from the short time fourier transform of input audio signal, the first reference audio signal, and the second reference audio signal.

In some embodiments, a number of elements in the power spectrogram for the input audio signal is not the same as a number of elements in the power spectrogram for first reference audio signal.

In some embodiments, the input audio signal and the first reference audio signal include the same audio content from different content sources.

In some embodiments, the input audio signal and the first reference audio signal include different audio content.

In some embodiments, the processing function is used for at least one of audio restoration, audio remastering, audio upmixing, audio downmixing, audio source separation, and reconstruction of a missing audio channel.

In some embodiments, the first reference audio signal is a reference input audio signal and the second reference audio signal is a reference output audio signal produced by previously processing the reference input audio signal.

In some embodiments, the processing produces the output audio signal from the input audio signal that corresponds to a processing relationship between the first reference audio signal and the second reference audio signal.

In some embodiments, the method is performed in a mobile device.

In some embodiments, the apparatus is a mobile device.

Although the embodiments which incorporate the teachings of the present disclosure have been shown and described in detail herein, those skilled in the art can readily devise many other varied embodiments that still incorporate these teachings. Having described preferred embodiments for a method and apparatus for processing audio content, it is noted that modifications and variations can be made by persons skilled in the art in light of the above teachings. It is therefore to be understood that changes may be made in the particular embodiments disclosed which are within the scope of the teachings as outlined by the appended claims.

The invention claimed is:

1. A method comprising:

receiving audio content, the audio content including an input audio signal, a first reference audio signal, and a second reference audio signal, the first reference audio signal and the second reference audio signal having a processing relationship;

computing a short time Fourier transform for the input audio signal, the first reference audio signal, and the second reference audio signal;

computing a power spectrogram for the input audio signal, the first reference audio signal, and the second reference audio signal from the short time Fourier transform of the input audio signal, the first reference audio signal, and the second reference audio signal;

determining a processing function for the input audio signal, the processing function corresponding to the processing relationship between the first reference signal and the second reference signal, the processing function determined based on a cost function between the input audio signal, the first reference audio signal and a second reference audio signal, wherein the cost function is formed using the power spectrogram of the input audio signal, the first reference audio signal, and the second reference audio signal; and processing the input audio signal using the determined processing function to produce an output audio signal.

2. The method of claim 1, wherein the cost function is further formed using a first matrix containing a first submatrix including the power spectrogram of the input audio signal, a second submatrix including the power spectrogram of the first reference audio signal, a third submatrix including the power spectrogram of the second reference audio signal, and a fourth submatrix associated with the output audio signal.

3. The method of claim 2, wherein the fourth submatrix initially includes values equal to a constant value.

4. The method of claim 2, wherein the cost function is further formed using a second matrix having a dimensionality equal to the first matrix and including a submatrix located in a portion of the second matrix that is equivalent to the fourth submatrix in the first matrix, the fourth submatrix having values equal to zero.

5. The method of claim 4, wherein a portion of the second matrix not including the submatrix portion has values that are nonzero and dependent on the weighting of the first reference audio signal and the second reference audio signal in the cost function.

6. The method of claim 1, wherein a number of elements in the power spectrogram for the input audio signal is not the same as a number of elements in the power spectrogram for first reference audio signal.

7. The method of claim 1, wherein the input audio signal and the first reference audio signal include the same audio content from different content sources.

8. The method of claim 1, wherein the input audio signal and the first reference audio signal include different audio content.

9. The method of claim 1, wherein the processing function is used for at least one of audio restoration, audio remastering, audio upmixing, audio downmixing, audio source separation, and reconstruction of a missing audio channel.

10. The method of claim 1, wherein the first reference audio signal is a reference input audio signal and the second reference audio signal is a reference output audio signal produced by previously processing the reference input audio signal.

11. The method of claim 1, wherein the method is performed in a mobile device.

12. An apparatus comprising:

an input interface that receives audio content, the audio content including an input audio signal, a first reference audio signal, and a second reference audio signal, the first reference audio signal and the second reference audio signal having a processing relationship; and a processor coupled to the input interface, the processor computing a short time Fourier transform for the input audio signal, the first reference audio signal, and the second reference audio signal, computing a power spectrogram for the input audio signal, the first reference audio signal, and the second reference audio signal from the short time Fourier transform of input audio signal, the first reference audio signal, and the second reference audio signal, determining a processing function for the input audio signal, the processing function corresponding to the processing relationship between the first reference audio signal and the second reference audio signal, the processing function determined based on a cost function between the input audio signal, the first reference audio signal and the second reference audio signal, wherein the cost function is formed using the power spectrogram of the input audio signal, the first reference audio signal, and the second reference audio signal, the processor further processing the input audio signal using the determined processing function to produce an output audio signal.

13. The apparatus of claim 12, wherein the cost function is further formed using a first matrix containing a first submatrix including the power spectrogram of the input audio signal, a second submatrix including the power spectrogram of the first reference audio signal, a third submatrix including the power spectrogram of the second reference audio signal, and a fourth submatrix associated with the output audio signal.

14. The apparatus of claim 13, wherein the fourth submatrix initially includes values equal to a constant value.

15. The apparatus of claim 13, wherein the cost function is further formed using a second matrix having a dimensionality equal to the first matrix and including a submatrix located in a portion of the second matrix that is equivalent to the fourth submatrix in the first matrix, the fourth submatrix having values equal to zero.

16. The apparatus of claim 15, wherein a portion of the second matrix not including the submatrix portion has values that are nonzero and dependent on the weighting of the first reference audio signal and the second reference audio signal in the cost function.

17. The apparatus of claim 12, wherein a number of elements in the power spectrogram for the input audio signal is not the same as a number of elements in the power spectrogram for first reference audio signal.

18. The apparatus of claim 12, wherein the input audio signal and the first reference audio signal include the same audio content from different content sources.

19. The apparatus of claim 12, wherein the input audio signal and the first reference audio signal include different audio content.

20. The apparatus of claim 12, wherein the processing function is used for at least one of audio restoration, audio remastering, audio upmixing, audio downmixing, audio source separation, and reconstruction of a missing audio channel.

21. The apparatus of claim 12, wherein the first reference audio signal is a reference input audio signal and the second reference audio signal is a reference output audio signal produced by previously processing the reference input audio signal.

22. The apparatus of claim 12, wherein the apparatus is a mobile device.

* * * * *